US005486440A

United States Patent [19]

Kashizaki et al.

[11] Patent Number: 5,486,440

[45] Date of Patent: Jan. 23, 1996

[54] ELECTROPHOTOGRAPHIC PHOTOSENSITIVE MEMBER, AND PROCESS CARTRIDGE AND ELECTROPHOTOGRAPHIC APPARATUS EMPLOYING THE SAME

[75] Inventors: Yoshio Kashizaki; Hajime Miyazaki; Koichi Suzuki; Shintetsu Go; Kazuma Sato, all of Yokohama, Japan

[73] Assignee: Canon Kabushiki Kaisha, Tokyo, Japan

[21] Appl. No.: 266,687

[22] Filed: Jun. 28, 1994

[30] Foreign Application Priority Data

Jun. 30, 1993 [JP] Japan ..... 5-160882

[51] Int. Cl.[6] ..... G06G 5/14; G06G 15/08; G06G 15/00

[52] U.S. Cl. ..... 430/62; 430/60; 430/63; 430/64; 355/211; 118/653

[58] Field of Search ..... 430/60, 62, 63, 430/64; 355/211; 118/653

[56] References Cited

U.S. PATENT DOCUMENTS

| | | | |
|---|---|---|---|
| 4,355,089 | 10/1982 | van Turnhout et al. | 430/83 X |
| 4,363,860 | 12/1982 | van Turnhout et al. | 430/83 |
| 4,728,593 | 3/1988 | Freilich et al. | 430/72 |
| 5,079,121 | 1/1992 | Facci et al. | 430/62 |
| 5,278,013 | 1/1994 | Kashizaki et al. | 430/58 |

FOREIGN PATENT DOCUMENTS

| | | |
|---|---|---|
| 0596504 | 5/1994 | European Pat. Off. . |
| 0609511 | 8/1994 | European Pat. Off. . |
| 2165295 | 8/1972 | Germany . |
| 48-47344 | 7/1973 | Japan . |
| 51-126149 | 11/1976 | Japan . |
| 52-20836 | 2/1977 | Japan . |
| 52-25638 | 2/1977 | Japan . |
| 53-89435 | 8/1978 | Japan . |
| 54-26738 | 2/1979 | Japan . |
| 55-103356 | 8/1980 | Japan . |
| 2115858 | 4/1990 | Japan . |

OTHER PUBLICATIONS

Patent Abst. of Japan, vol. 16, No. 93 (C–917) 1992, JP 03–275725.

Database WPI, Week 8901, Derwent, Cl. A12, AN89–3178 (01)–JP63–280257.

Patent Abst. of Japan, vol. 12, No. 390 (P–772) 1988 of JP63–132251.

Database WPI, Week 9245, Derwent, AN92–37058 [45] JP4–273248.

*Primary Examiner*—Roland Martin

*Attorney, Agent, or Firm*—Fitzpatrick, Cella, Harper & Scinto

[57] ABSTRACT

An electrophotographic photosensitive member is disclosed which has an electroconductive support, an interlayer, and a photosensitive layer. The interlayer contains a resin having a polyamic acid structure or a polyamic acid ester structure. A process cartridge and electrographic apparatus using the photosensitive member are also disclosed.

20 Claims, 1 Drawing Sheet

ELECTROPHOTOGRAPHIC PHOTOSENSITIVE MEMBER, AND PROCESS CARTRIDGE AND ELECTROPHOTOGRAPHIC APPARATUS EMPLOYING THE SAME

BACKGROUND OF THE INVENTION

1. Field of the Invention

The present invention relates to an electrophotographic photosensitive member, particularly to an electrophotographic photosensitive member having an interlayer which contains a resin of a specified structure.

The present invention also relates to a process cartridge and an electrophotographic apparatus employing the above electrophotographic photosensitive member.

2. Related Background Art

The electrophotographic photosensitive member has normally a photosensitive layer on an electroconductive support. Usually the photosensitive layer is extremely thin, and its thickness is liable to be irregular at defect points on the surface of the support: such as scratches and adhering matter. This liability to irregularities is particularly significant in the widely used function-separation type photosensitive layer constituted of a charge-generating layer as thin as 0.5 μm and a charge-transporting layer.

The photosensitive layer is required to be formed as uniformly as possible in thickness since an irregularity in thickness thereof will give rise to irregularity of potential or sensitivity.

Another important characteristic property of the electrophotographic photosensitive member is stability of light area potential and dark area potential during repeated use. Without the potential stability, the formed image density will be unstable or the formed image will be fogged.

To offset such disadvantages, an interlayer is provided which serves to cover any surface defects of the support, to improve adhesion of the support with the photosensitive layer, and to prevent carrier injection from the support into the photosensitive layer.

The interlayer is conventionally formed from a resin: including polyamide resins (Japanese Patent Application Laid-Open Nos. 48-47344 and 52- 25638), polyester resins (Japanese Patent Application Laid-Open Nos. 52-20836 and 54-26738), polyurethane resins (Japanese Patent Application Laid-Open Nos. 53- 89435 and 2-115858), quaternary ammonium salt-containing acrylic polymers (Japanese Patent Application Laid-Open No. 51-126149) and casein (Japanese Patent Application Laid-Open No. 55-103556).

The interlayer formed from any of the above materials, however, changes its electric resistance depending on temperature and humidity. Therefore, an excellent electrophotographic photosensitive member is not obtainable which has excellent and stable potential characteristics throughout all the environmental conditions from low-temperature and low-humidity to high-temperature and high-humidity.

For example, when the photosensitive member is repeatedly used under the conditions of low temperature and low humidity where the electric resistance of the interlayer tends to rise, the electric charge tends to remain in the interlayer, resulting in rise of light area potential and residual potential. Consequently, the copied image becomes fogged during normal development or the image becomes thin during reversal development, being incapable of giving continuously a desired quality of recorded images.

On the other hand, under the conditions of high temperature and high humidity, the barrier function of the interlayer tends to decline to increase carrier injection from the support, whereby the dark area potential falls. Consequently, the copied image becomes thin in normal development, or the image exhibits black dot-shaped defects or becomes fogged in reversal development.

Moreover, the interlayer frequently causes decrease in the sensitivity of the photosensitive member, even if the interlayer improves the stability of potential at low temperature and low humidity, and prevents formation of black dot-shaped defects in the image at high temperature and high humidity.

SUMMARY OF THE INVENTION

The present invention intends to provide an electrophotographic photosensitive member which exhibits stable and excellent potential characteristics in any environmental conditions from low-temperature and low-humidity to high-temperature and high-humidity and which is uniformly capable of forming images as excellent as the image at the initial stage.

The present invention intends also to provide an electrophotographic photosensitive member comprising an interlayer having sufficient adhesiveness to the support and excellent film-forming properties to form a defectless excellent image with high sensitivity.

The present invention further intends to provide a process cartridge and an electrophotographic apparatus which employ the above electrophotographic photosensitive member.

The electrophotographic photosensitive member of the present invention comprises an electroconductive support, an interlayer formed on the electroconductive support, and a photosensitive layer formed on the interlayer, the interlayer containing a resin having a polyamic acid structure or a polyamic acid ester structure.

The process cartridge and the electrophotographic apparatus of the present invention employ the above electrophotographic photosensitive member.

DETAILED DESCRIPTION OF THE PREFERRED EMBODIMENTS

Figure 1:
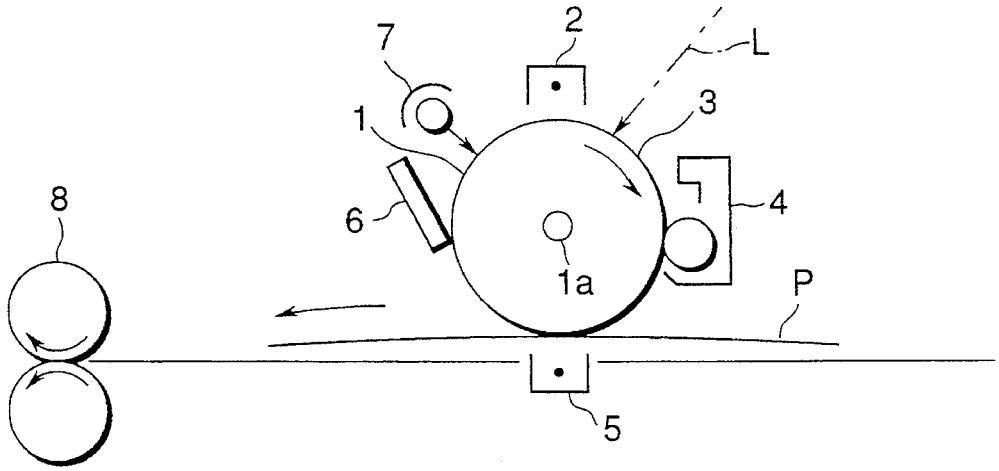
FIG. 1 shows schematically a constitution of an electrophotographic apparatus employing an electrophotographic photosensitive member of the present invention.

The interlayer of the electrophotographic photosensitive member of the present invention contains a resin having a polyamic acid structure or a polyamic acid ester structure.

The amic acid structure and the amic acid ester structure may include various structures given later, and particularly preferred ones are represented by Formulas (1) and (2):

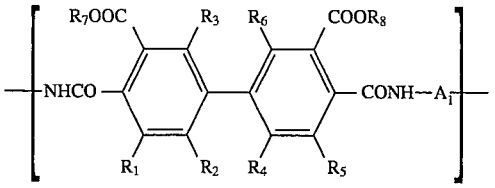

(1)

where $A_1$ is a bivalent organic group; $R_1$ to $R_6$ are independently a hydrogen atom, a halogen atom, a substituted or unsubstituted alkyl group, a substituted or unsubstituted alkoxy group, or a cyano group; and $R_7$ and $R_8$ are independently a hydrogen atom, a substituted or unsubstituted alkyl group, a substituted or unsubstituted alkoxyalkyl group, or a substituted or unsubstituted aralkyl group, and

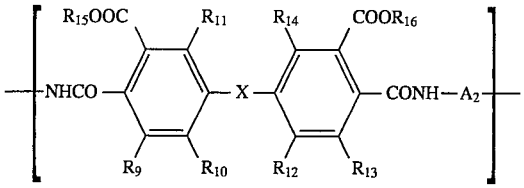

(2)

where $A_2$ is a bivalent organic group; $R_9$ to $R_{14}$ are independently a hydrogen atom, a halogen atom, a substituted or unsubstituted alkyl group, a substituted or unsubstituted alkoxy group, or a cyano group; $R_{15}$ and $R_{16}$ are independently a hydrogen atom, a substituted or unsubstituted alkyl group, a substituted or unsubstituted alkoxyalkyl group, or a substituted or unsubstituted aralkyl group; and X is an oxygen atom, a substituted or unsubstituted alkylene group, a carbonyl group, or a sulfonyl group.

The above bivalent organic group, $A_1$ and $A_2$ include various groups as mentioned later. Particularly preferred are the groups represented by Formulas (3) and (4):

$$—Ar_1— \quad (3)$$

where $Ar_1$ is a substituted or unsubstituted aromatic hydrocarbon group or a substituted or unsubstituted aromatic heterocyclic group; and $$—Ar_2—Y—Ar_3— \quad (4)$$

where $Ar_2$ and $Ar_3$ are independently a substituted or unsubstituted aromatic hydrocarbon ring group or a substituted or unsubstituted aromatic heterocyclic group; and Y is an oxygen atom, a sulfur atom, a substituted or unsubstituted alkylene group, a carbonyl group, or a sulfonyl group.

The aromatic hydrocarbon group for $Ar_1$, $Ar_2$, and $Ar_3$ includes phenylene, biphenylene, naphthalene, and the like, and the aromatic heterocyclic group for $Ar_1$, $Ar_2$, and $Ar_3$ includes pyridinediyl, thiophenediyl, and the like. The alkylene group for Y includes methylene, ethylene, propylene, isopropylene, and the like. The substituent which may substitute the above groups includes alkyl groups such as methyl, ethyl, and propyl; halogen atoms such as fluorine, chlorine, and bromine; halomethyl groups such as trifluoromethyl; alkoxy groups such as methoxy, ethoxy, and propoxy; alkylamino groups such as dimethylamino, and diethylamino; acyl groups such as acetyl and benzoyl; and a cyano group.

Preferred examples of the bivalent organic group $A_1$ and $A_2$ are shown below without limiting the groups thereto.

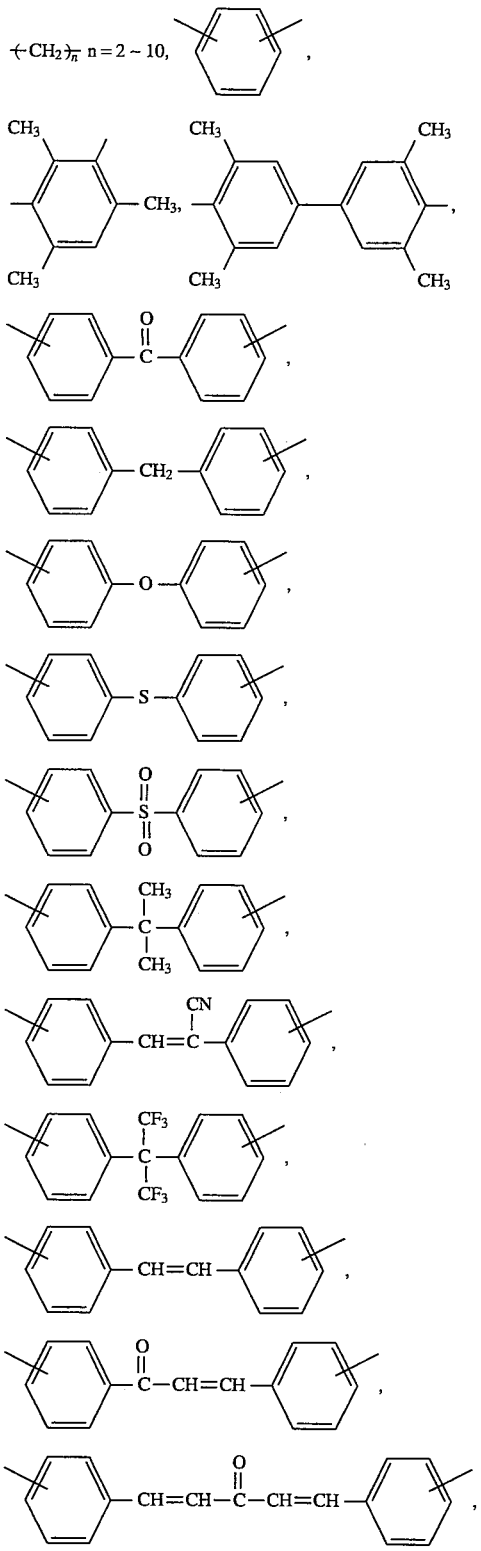

-continued
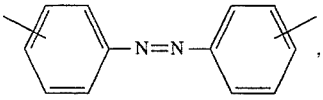
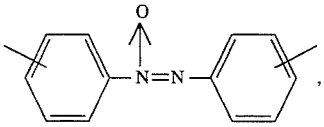
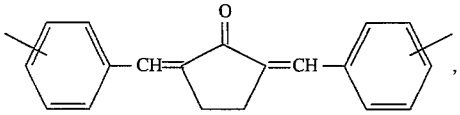
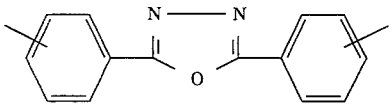
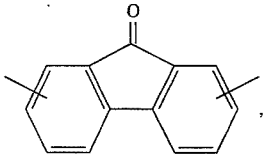
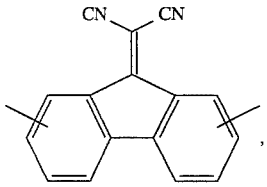
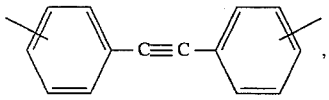
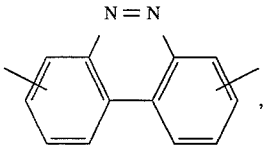
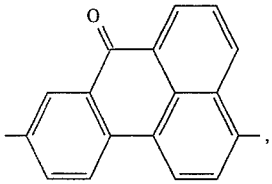
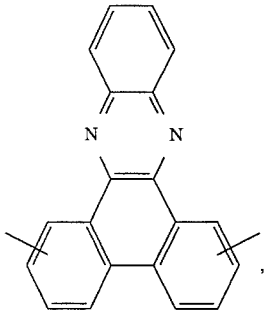
-continued
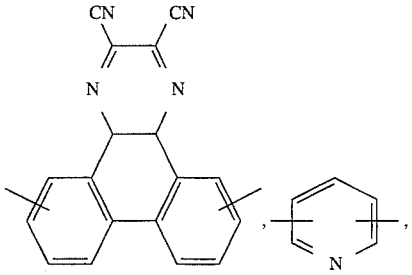
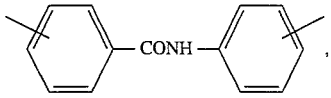
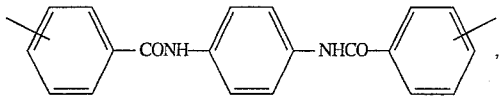
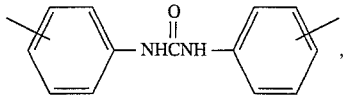
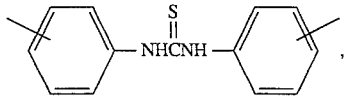
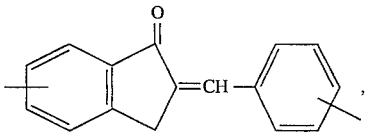
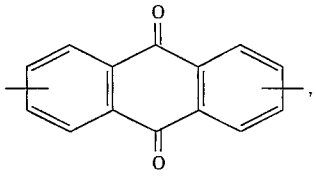
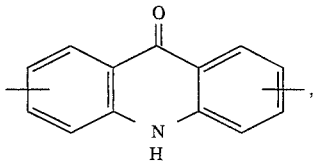
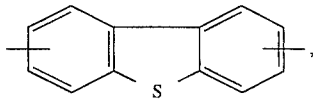
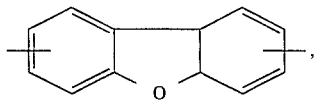
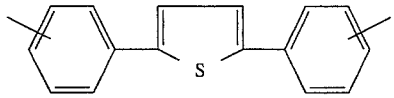
Of these preferred groups, particularly preferred are as follows:

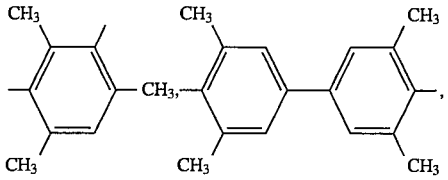

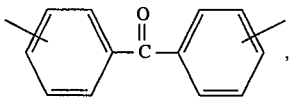

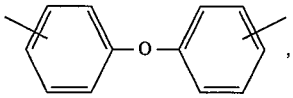

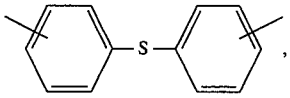

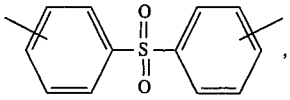

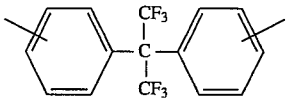

Of these, still particularly preferred are as follows:

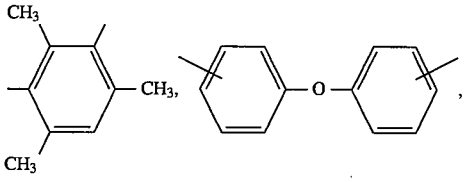

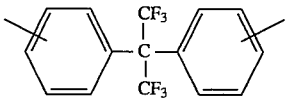

In Formulas (1) and (2), $R_1$ to $R_6$, and $R_{14}$ are independently a hydrogen atom; a halogen atom such as fluorine, chlorine, and bromine; an alkyl group such as methyl, ethyl, and propyl; an alkoxy group such as methoxy, ethoxy, and propoxy; and a cyano group. $R_1$ to $R_6$, and $R_9$ to $R_{14}$ may have a further substituent such as a halogen atom.

In Formulas (1) and (2), $R_7$, $R_8$, $R_{15}$, and $R_{16}$ are independently a hydrogen atom; an alkyl group such as methyl, ethyl, and propyl; an alkoxyalkyl group such as methoxyethyl; and an aralkyl group such as benzyl. $R_7$, $R_8$, $R_{15}$, and $R_{16}$ may have a further substituent such as a halogen atom.

In Formula (2), the alkylene group as X includes groups of methylene, ethylene, propylene, and isopropylene, and the substituent which may substitute the alkylene group includes halogen atoms such as fluorine, chlorine, and bromine; acyl groups such as acetyl, and benzoyl; and a cyano group.

The resin used in this invention has a number average molecular weight of, preferably 500 to 100,000, more preferably 10,000 to 50,000.

In the process for producing the electrophotographic photosensitive member of the present invention, polyimide structure may be formed in the polyamic acid structure or the polyamic acid ester structure by dehydration reaction of the amide moiety with the acid moiety or the acid ester moiety, depending on the conditions of the usually conducted drying treatment. In the present invention, a segment having the amic acid structure and amic acid ester structure in the resin constitutes preferably 20 to 80 mol %, more preferably 40 to 60 mol % of segments in the entire resin. The reason therefor is not clear. Presumably, the polyamic acid structure or the polyamic acid ester structure inhibits injection of positive holes from the electroconductive support to promote dissociation of the carrier generated by the charge-generating substance and injection of electrons into the interlayer, and densely packed polyimide structure further promotes the above dissociation of carrier and the injection and the transfer of electrons, and mitigates the influence of moisture.

Specific examples of the resin of the present invention are enumerated below without limiting the invention.

| Exemplified Compound No. | $R_1$–$R_6$ | $R_7$ and $R_8$ | $A_1$ |
|---|---|---|---|
| 1 | H | H | 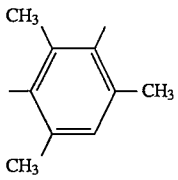 |
| 2 | H | H | 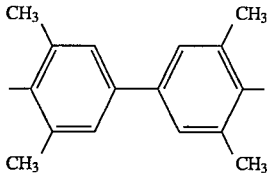 |

-continued
| | | | |
|---|---|---|---|
| 3 | H | H | 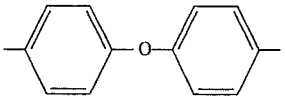 |
| 4 | H | H | 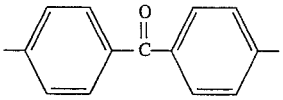 |
| 5 | H | H | 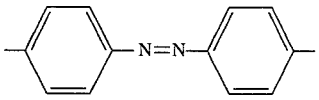 |
| 6 | H | H | 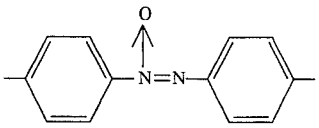 |
| 7 | H | H | 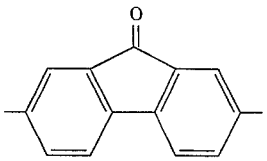 |
| 8 | H | H | 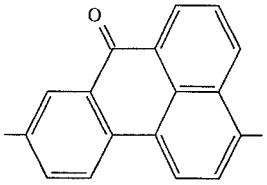 |
| 9 | H | H | 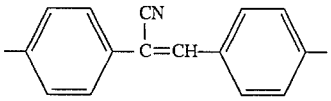 |
| 10 | H | H | 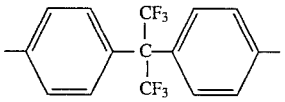 |
| 11 | H | H | 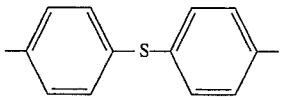 |
| 12 | H | H | 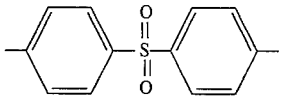 |
| 13 | H | H | 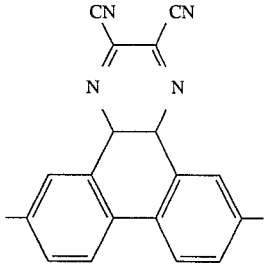 |
| 14 | $R_{1,3,5,6}=H$<br>$R_{2,4}=F$ | H | 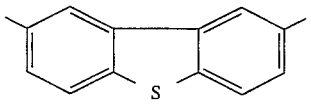 |

-continued
| | | | |
|---|---|---|---|
| 15 | H | H | 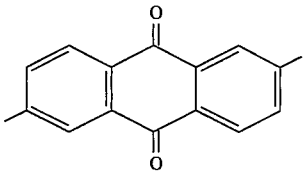 |
| 16 | $R_{1,2,4,5}=H$<br>$R_{3,6}=CH_3$ | H | 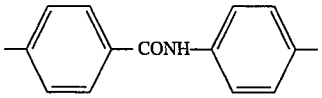 |
| 17 | H | H | 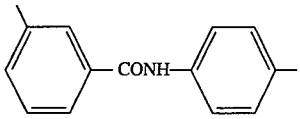 |
| 18 | H | H | 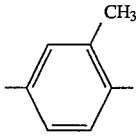 |
| 19 | H | H | 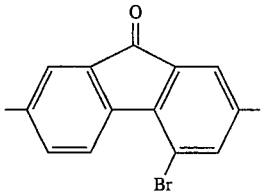 |
| 20 | H | H | 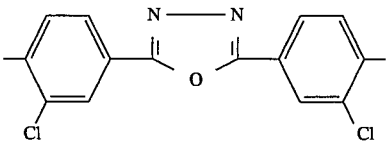 |
| 21 | $R_{1,2,4,5}=H$<br>$R_{3,6}=CF_3$ | H | 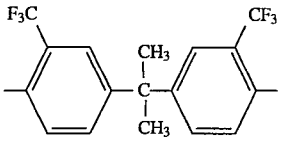 |
| 22 | H | H | 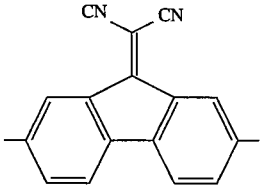 |
| 23 | H | H | $\leftarrow CH_2 \rightarrow_6$ |
| 24 | H | H | $\leftarrow CH_2 \rightarrow_8$ |
| 25 | H | $CH_3$ | 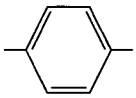 |
| 26 | H | $CH_3$ | 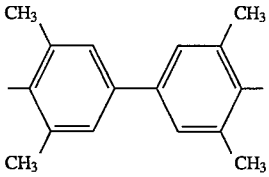 |

-continued
| | | | |
|---|---|---|---|
| 27 | H | $C_2H_5$ | 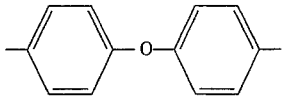 |
| 28 | H | $CH_3$ | 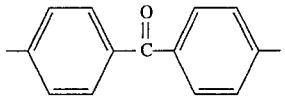 |
| 29 | H | $CH_3$ | 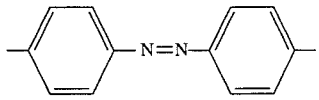 |
| 30 | H | $CH_3$ | 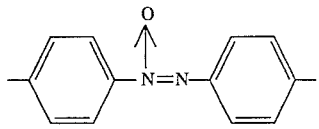 |
| 31 | H | $C_2H_5$ | 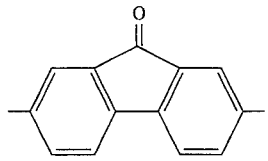 |
| 32 | H | $C_2H_5$ | 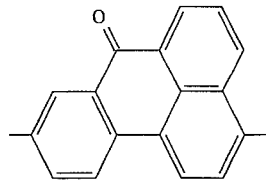 |
| 33 | H | $CH_3$ | 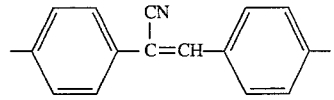 |
| 34 | H | $CH_3$ | 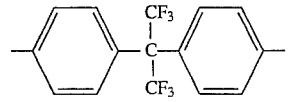 |
| 35 | H | 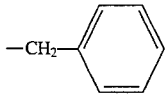 | 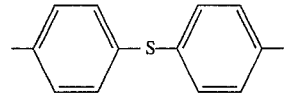 |
| 36 | H | n-$C_3H_7$ | 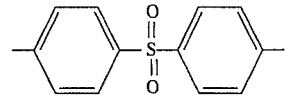 |
| 37 | H | 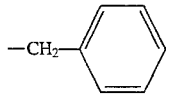 | 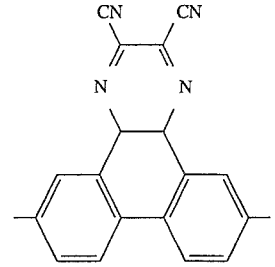 |
| 38 | H | $CH_3$ | 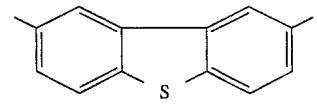 |

-continued
| | | | |
|---|---|---|---|
| 39 | H | $CH_3$ | 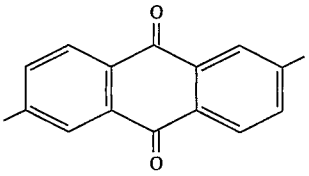 |
| 40 | H | $CH_3$ | 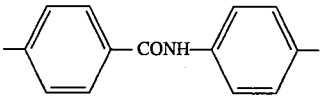 |
| 41 | H | $C_2H_5$ | 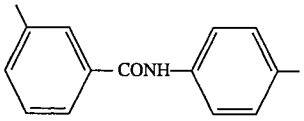 |
| 42 | H | n-$C_3H_7$ | 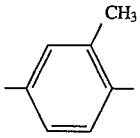 |
| 43 | H | $CH_3$ | 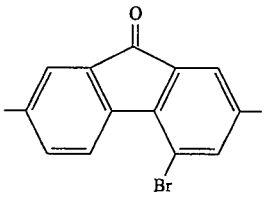 |
| 44 | H | $CH_3$ | 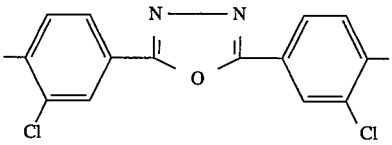 |
| 45 | $R_{1,3,4,5,6}$ = H<br>$R_2$ = $OCH_3$ | $CH_3$ | 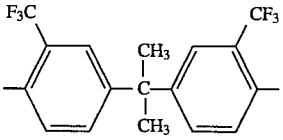 |
| 46 | H | $C_2H_5$ | 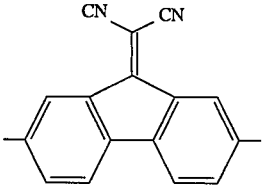 |
| 47 | $R_{1,3,4,5,6}$ = H<br>$R_2$ = Cl | $CH_3$ | $\leftarrow CH_2 \rightarrow_6$ |
| 48 | $R_{1,3,4,5,6}$ = H<br>$R_2$ = $CH_3$ | $CH_3$ | $\leftarrow CH_2 \rightarrow_8$ |
| Exemplified Compound No. | $R_9$–$R_{14}$ | $R_{15}$ and $R_{16}$ | X | $A_2$ |
|---|---|---|---|---|
| 49 | H | H | $-\overset{O}{\overset{\|\|}{C}}-$ | 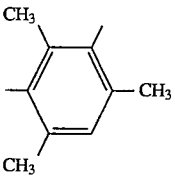 |

-continued
| | | | | |
|---|---|---|---|---|
| 50 | H | H | $-\overset{O}{\overset{\|\|}{C}}-$ | 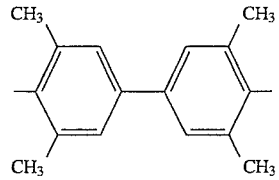 |
| 51 | H | H | $-\overset{O}{\overset{\|\|}{C}}-$ | 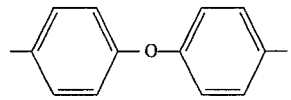 |
| 52 | H | H | $-\overset{O}{\overset{\|\|}{C}}-$ | 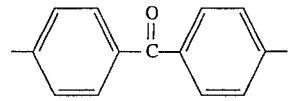 |
| 53 | H | H | $-\overset{O}{\overset{\|\|}{C}}-$ | 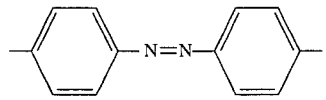 |
| 54 | H | H | $-\overset{O}{\overset{\|\|}{C}}-$ | 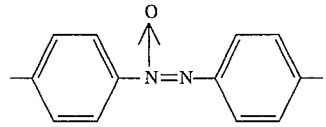 |
| 55 | H | H | $-\overset{O}{\overset{\|\|}{C}}-$ | 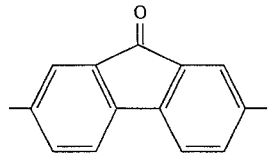 |
| 56 | H | H | $-\overset{O}{\overset{\|\|}{C}}-$ | 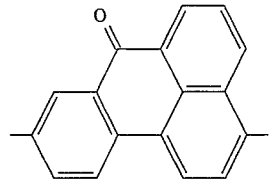 |
| 57 | H | H | $-\overset{O}{\overset{\|\|}{C}}-$ | 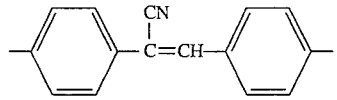 |
| 58 | H | H | $-\overset{O}{\overset{\|\|}{C}}-$ | 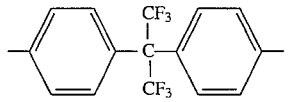 |
| 59 | H | H | $-\overset{O}{\overset{\|\|}{C}}-$ | 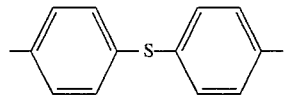 |
| 60 | H | H | $-\overset{O}{\overset{\|\|}{C}}-$ | 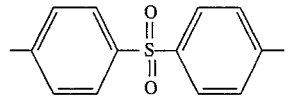 |

-continued

| | | | | |
|---|---|---|---|---|
| 61 | H | H | $-\overset{O}{\overset{\|\|}{C}}-$ | 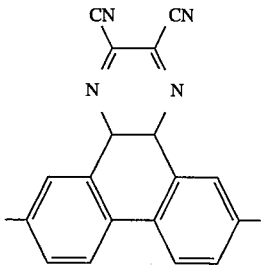 |
| 62 | H | H | $-\overset{O}{\overset{\|\|}{C}}-$ | 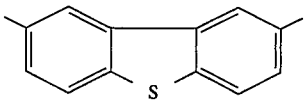 |
| 63 | H | H | $-\overset{O}{\overset{\|\|}{C}}-$ | 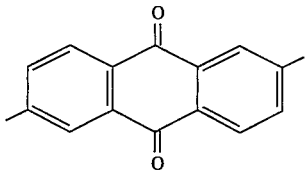 |
| 64 | H | H | $-\overset{O}{\overset{\|\|}{C}}-$ | 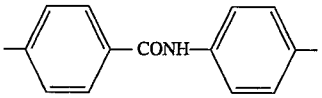 |
| 65 | H | H | $-\overset{O}{\overset{\|\|}{C}}-$ | 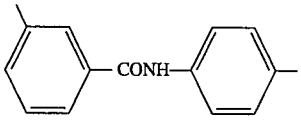 |
| 66 | H | H | $-\overset{O}{\overset{\|\|}{C}}-$ | 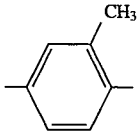 |
| 67 | H | H | $-\overset{O}{\overset{\|\|}{C}}-$ | 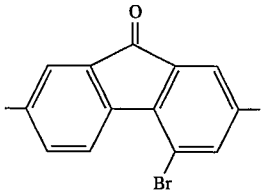 |
| 68 | H | H | $-\overset{O}{\overset{\|\|}{C}}-$ | 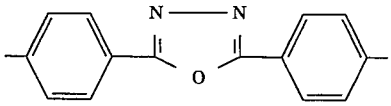 |
| 69 | $R_{9,10,12,13}=H$<br>$R_{11,14}=CH_3$ | H | $-\overset{O}{\overset{\|\|}{C}}-$ | 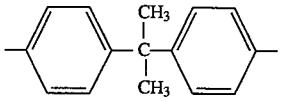 |
| 70 | H | H | $-\overset{CH_3}{\underset{CH_3}{\overset{\|}{\underset{\|}{C}}}}-$ | 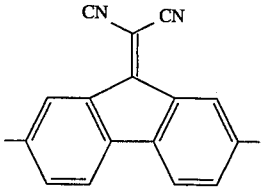 |
| 71 | H | H | $-CH_2-$ | $\leftarrow CH_2 \rightarrow_6$ |

-continued
| | | | | |
|---|---|---|---|---|
| 72 | H | H | $-C(CF_3)_2-$ | $-(CH_2)_8-$ |
| 73 | H | $CH_3$ | $-C(=O)-$ | 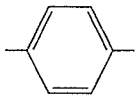 |
| 74 | H | $CH_3$ | $-C(=O)-$ | 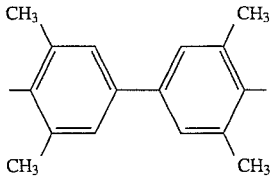 |
| 75 | H | $C_2H_5$ | $-C(=O)-$ | 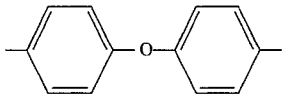 |
| 76 | H | $CH_3$ | $-C(=O)-$ | 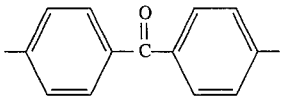 |
| 77 | H | $CH_3$ | $-C(=O)-$ | 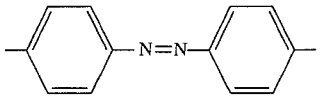 |
| 78 | H | $CH_3$ | $-CH_2-$ | 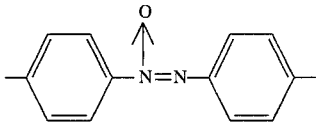 |
| 79 | H | $C_2H_5$ | $-S(=O)_2-$ | 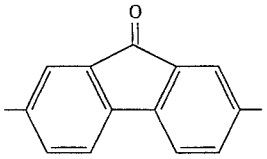 |
| 80 | H | $C_2H_5$ | $-C(CH_3)_2-$ | 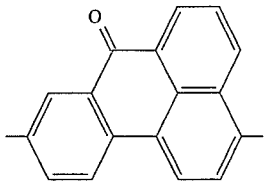 |
| 81 | H | $CH_3$ | $-C(=O)-$ | 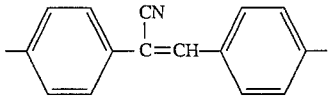 |
| 82 | H | $CH_3$ | $-C(=O)-$ | 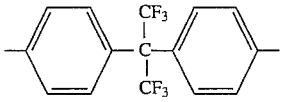 |
| 83 | H | 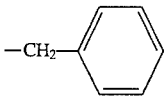 | $-C(=O)-$ | 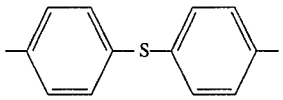 |
| 84 | H | n-$C_3H_7$ | $-C(=O)-$ | 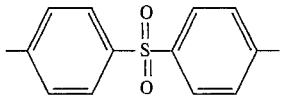 |

-continued
| | | | | |
|---|---|---|---|---|
| 85 | H | $-CH_2-$ 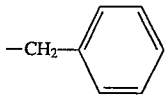 | $-\overset{O}{\overset{\|\|}{C}}-$ | 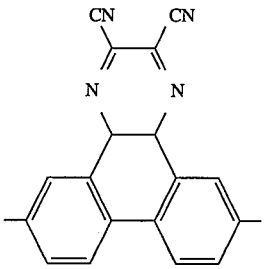 |
| 86 | H | $CH_3$ | $-\overset{O}{\overset{\|\|}{C}}-$ | 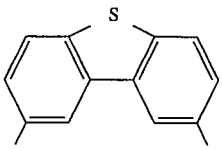 |
| 87 | H | $CH_3$ | $-\overset{O}{\overset{\|\|}{C}}-$ | 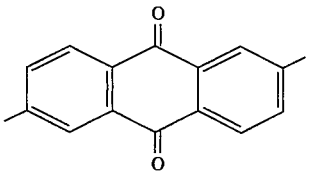 |
| 88 | H | $CH_3$ | $-\overset{O}{\overset{\|\|}{C}}-$ | 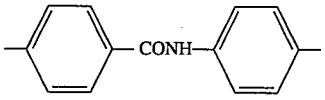 |
| 89 | H | $C_2H_5$ | $-\overset{O}{\overset{\|\|}{C}}-$ | 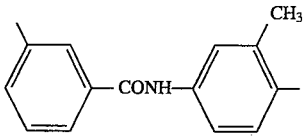 |
| 90 | H | n-$C_3H_7$ | $-\overset{O}{\overset{\|\|}{C}}-$ | 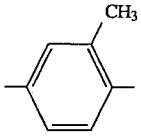 |
| 91 | H | $CH_3$ | $-\overset{O}{\overset{\|\|}{C}}-$ | 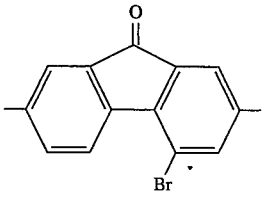 |
| 92 | H | $CH_3$ | $-\overset{O}{\overset{\|\|}{C}}-$ | 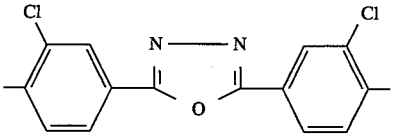 |
| 93 | $R_{9,11,12,13,14}=H$<br>$R_{10}=OCH_3$ | $CH_3$ | $-\overset{CF_3}{\underset{CF_3}{C}}-$ | 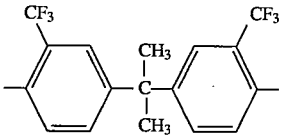 |

-continued

| | | | | |
|---|---|---|---|---|
| 94 | H | $C_2H_5$ | O<br>‖<br>—C— | 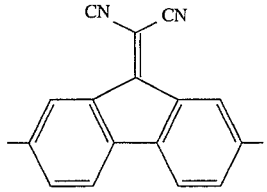 |
| 95 | $R_{9,11,12,13,14}$ = H<br>$R_{10}$ = Cl | $CH_3$ | O<br>‖<br>—C— | $\leftarrow CH_2 \rightarrow_6$ |
| 96 | $R_{9,11,12,13,14}$ = H<br>$R_{10}$ = $CH_3$ | $CH_3$ | O<br>‖<br>—S—<br>‖<br>O | $\leftarrow CH_2 \rightarrow_8$ |

Among the above compounds, preferred are Exemplified compound Nos. 1, 2, 3, 4, 10, 11, 12, 26, 27, 28, 34, 35, 36, 49, 50, 51, 52, 58, 59, 60, 74, 75, 76, 82, 83, and 84 in view of the environmental stability of the electrophotographic photosensitive member, inherent stability of the compounds, ease of synthesis of the compounds, and low cost. Of these particularly preferred are Exemplified Compound Nos.1, 3, 10, 27, 34, 49, 51, 58, 75, and 82.

The resin having polyamic acid structure may be synthesized by ring-opening polyaddition reaction of a tetracarboxylic acid dianhydride and a diamine in an organic polar solvent. The organic polar solvent includes amide type solvents such as N,N-dimethylacetamide, N,N-dimethylformamide, and N-methylpyrrolidone; phenol type solvents such as cresol, and chlorophenol; ether type solvents such as diethylene glycol dimethyl ether; and mixtures thereof. In order to control the molecular weight of the resin, water may be contained at a content of not higher than 5%. The reaction temperature is preferably in the range of from 20° C. to 120° C., more preferably from 20° C. to 40° C.

The resin having a polyamic acid ester structure employed in the present invention can be synthesized by esterifying the above polyamic acid with an alcohol in the presence of a suitable catalyst. The catalyst includes mineral acids such as sulfuric acid and hydrochloric acid, and organic acids such as p-toluenesulfonic acid. The resin can be synthesized also by reaction of a half-esterified tetracarboxylic acid diamine with a diamine.

The aforementioned polyimide can be synthesized by heating the above polyamic acid or the above polyamide ester at a temperature preferably ranging from 50° C. to 400° C. for heat treatment time ranging preferably from 5 minutes to 4 hours. The temperature and the time of this heat treatment greatly affect the ratio of the polyamic acid or the polyamic acid ester to the polyimide structure. The ratio can be determined by IR spectroscopy from the ratio of the absorbance at 1500 $cm^{-1}$ assigned to phenylene to the absorbance at 1770–1780 $cm^{-1}$ assigned to imide, or otherwise by $H_1$-NMR spectroscopy from determination of protons of the carboxylic acid group or the carboxylic acid ester group.

A synthesis example of a polyamic acid employed in the present invention is shown below.

SYNTHESIS EXAMPLE

Into a 500 -ml four-neck flask, were placed 14.7 g (0.05 mol) of the compound represented by the structural formula below:

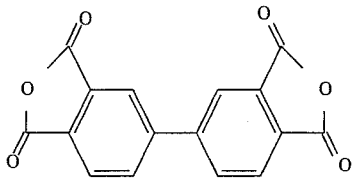

and 160 g of N,N-dimethylacetamide under a dry nitrogen gas stream. Thereto, 10.0 g (0.05 mol) of 4,4'-diaminodiphenyl ether was gradually added in one to two minutes with vigorous agitation. Further the mixture was allowed to react for 2 hours with agitation under a nitrogen stream to obtain a pale yellow viscous liquid reaction mixture. To the liquid reaction mixture, 160 g of N,N-dimethylacetamide was added to obtain a homogeneous solution. The solution was added dropwise into 5 liters of methanol with vigorous agitation. The precipitated polyamic acid was collected by filtration. The collected matter was again dissolved in 250 g of N,N-dimethylacetamide, and insoluble matter was removed by filtration. The filtrate was added dropwise into 5 liters of methanol to precipitate the polymer. The precipitated polymer was washed with 2 liters of methanol and was dried to obtain 16.3 g of the polyamide of Exemplified Compound No. 3.

Other polyamides employed in the present invention can be synthesized in the same manner as above.

The interlayer in the present invention may be of a monolayer structure, or of a two- or multi-layer structure provided that at least one of the constituting layers contains the resin of the present invention. When the interlayer is constituted of two or more layers, resins other than those of the present invention are exemplified by polyamide resins, polyester resins, and phenol resins.

The interlayer of the present invention may contain a second resin, an additive, an electroconductive substance, or the like, if necessary, in an amount such that the effect of the present invention is achieved. The second resin includes polyamide resins, polyester resins, and phenol resins. The additive includes acceptor type compounds such as 2,5,7-trinitrofluorenone and benzoquinone. The electroconductive substance includes powdery metals such as aluminum, copper, nickel, and silver; metal short fibers; carbon fibers; electroconductive powdery matters such as carbon black, titanium black, graphite, metal oxides and sulfides (e.g., antimony oxide, indium oxide, tin oxide, titanium oxide, zinc oxide, potassium titanate, barium titanate, magnesium titanate, zinc sulfide, copper sulfide, magnesium oxide, aluminum oxide, etc.), and such metal oxides and sulfides treated at their surface with an electroconductive substance, a silane-coupling agent, or a titanium coupling agent, or treated for reduction.

The content of the resin of the present invention in the interlayer is in the range of preferably from 10 to 90% by weight, more preferably from 30 to 70% by weight base on the total weight of the resin-containing interlayer.

The thickness of the interlayer is suitably selected in consideration of the electrophotographic properties and defects of the support, and is preferably in the range of from 0.1 to 50 μm, more preferably from 0.5 to 30 μm.

The photosensitive layers of the electrophotographic photosensitive members of the present invention are classified roughly into a monolayer type which contains a charge-generating substance and a charge-transporting substance in the same layer, and a lamination type which comprises a charge generating layer containing a charge-generating substance and a charge-transporting layer containing a charge-transporting substance. The lamination type is further classified into the ones which have an electroconductive support, a charge-generating layer, and a charge-transporting layer in the order named, and the ones which have an electroconductive support, a charge-transporting layer, and a charge-generating layer in the order named. The present invention is suitable for the lamination type, particularly for the one having a charge-transporting layer formed on a charge-generating layer.

The charge-generating layer can be formed by dispersing a charge-generating substance in a solution of binder resin in a suitable solvent, applying the solution and drying the solution. The charge-generating substance includes azo pigments such as monoazo, bisazo, and trisazo; phthalocyanine pigments such as metal phthalocyanine and non-metal phthalocyanine; indigo pigments such as indigo and thioindigo; polycyclic quinone pigments such as anthanthrone and pyrenequinone; perylene pigments such as perylenic acid anhydride and perylenic imide; squarilium dyes; pyrylium and thiapyrylium salts; and triphenylmethane dyes. The binder resin includes vinyl acetal resins, styrene resins, polyester resins, vinyl acetate resins, methacrylic resins, acrylic resins, vinylpyrrolidone resins, and cellulose resins. The thickness of the charge-generating layer is preferably not larger than 5 μm, more preferably in the range of from 0.05 to 2 μm.

The charge-transporting layer can be formed by dissolving a charge-transporting substance mentioned below in a solution of a film-forming resin, and applying and drying the resulting solution. Charge-transporting substances are classified into electron-transporting substances and positive hole-transporting substances. The electron-transporting substances include electron-accepting substances such as 2,4,7-trinitrofluorenone, 2,4,5,7-tetranitrofluorenone, chloranil, and tetracyanoquinodimethane, and polymers thereof. The positive hole-transporting substances include polycyclic aromatic compounds such as pyrene and anthracene; heterocyclic compounds such as carbazole, indole, imidazole, oxazole, thiazole, oxadiazole, pyrazole, pyrazoline, thiadiazole and triazole; hydrazone compounds such as p-diethylaminobenzaldehydo-N,N-diphenylhydrazone and N,N-diphenylhydrazino- 3-methylidene-9-ethylcarbazole; styryl compounds such as α-phenyl-4'-N,N-diaminostilbene and 5-[4-(di-p-tolylamino)benzylidene]- 5H-dibenzo[a,d]dicycloheptene; benzidine type compounds; triarylamine type compounds; and polymers having a group derived from a triphenylamine compound or an analogous compound in the main chain or the side chain (e.g., poly-N-vinylcarbazole, polyvinylanthracene, etc.).

The film-forming resin includes polyester resins, polycarbonate resins, polymethacrylate resins, and polystyrene resins.

The thickness of the charge-transporting layer is preferably in the range of from 5 to 40 μm, more preferably from 10 to 30 μm.

If the photosensitive layer is of a monolayer type, it is formed by applying a solution of a binder resin containing the charge-generating substance and the charge-transporting substance as mentioned above dissolved or dispersed therein onto a substrate and drying it.

The photosensitive layer of the present invention may be an organic photosensitive polymer layer of polyvinylcarbazole, polyvinylanthracene or the like, a vapor deposition layer of the above charge-generating substance, a vapor deposition layer of selenium, a vapor deposition layer of selenium-tellurium, an amorphous silicon layer, or the like. The monolayer type photosensitive layer has preferably a thickness of from 5 to 40 μm, more preferably from 10 to 30 μm.

The electroconductive support employed in the present invention may be made of aluminum, aluminum alloys, copper, zinc, stainless steel, titanium, nickel, indium, gold, platinum, or a like material. The support may also be made of a plastic (e.g., polyethylene, polypropylene, polyvinyl chloride, polyethylene terephthalate, and acrylic resins, etc.) coated with the above mentioned metal or alloy by vapor deposition, or may be a plastic, metal, or alloy support coated with electroconductive particles (e.g., carbon black, particulate silver, etc.) with a suitable binder, or a plastic or paper sheet impregnated with electroconductive particles. The support may be in a shape of a drum, a sheet, a belt, or the like, and is preferably in a suitable shape for the applied electrophotographic photosensitive member.

A resin layer as a protective layer, which may contain optionally electroconductive particles, may be formed further on the photosensitive layer in the present invention.

The above respective layers may be applied by dip coating, spray coating, beam coating, spinner coating, roller coating, Meyer bar coating, blade coating, or the like method.

The electrophotographic photosensitive member of the present invention is useful for a variety of electrophotographic apparatuses such as electrophotographic copying machines, laser beam printers, LED printers, and liquid crystal shutter type printers, and for apparatuses employing the electrophotography technique such as apparatuses for display, recording, light printing, and engraving, and facsimile machines.

FIG. 1 illustrates schematically an example of the constitution of a transfer type electrophotographic apparatus employing an electrophotographic photosensitive member of the present invention.

In FIG. 1, a drum-shaped electrophotographic photosensitive member 1 of the present invention is driven to rotate around the axis 1*a* in the arrow direction at a prescribed peripheral speed. The photosensitive member 1 is charged positively or negatively at the peripheral face uniformly during the rotation by an electrostatic charging means 2, and then exposed to image-exposure light L (e.g., slit exposure, laser beam-scanning exposure, etc.) at the exposure portion 3 with an image-exposure means (not shown in the drawing), whereby an electrostatic latent image is successively formed on the peripheral surface in accordance with the exposed image.

The formed electrostatic latent image is developed with a toner by a developing means 4. The developed toner image is successively transferred by a transfer means 5 onto a surface of a transfer-receiving material P which is fed between the photosensitive member 1 and the transfer means 5 synchronously with the rotation of the photosensitive member 1 from a transfer-receiving material feeder not shown in the drawing.

The transfer-receiving material P which has received the transferred image is separated from the photosensitive member surface, and introduced to an image fixing means 8 for fixation of the image and sent out from the copying machine as a duplicate copy.

The surface of the photosensitive member 1, after the image transfer, is cleaned with a cleaning means 6 to remove any remaining non-transferred toner, and is treated for charge elimination with a pre-exposure means 7 for repeated use for image formation.

Two or more of the above constitutional elements including the electrophotographic photosensitive member 1, the electrostatic charging means 2, the developing means 4, the cleaning means 6, etc. may be integrated in one body as a process cartridge in the present invention. This process cartridge may be made demountable from the main body of the apparatus. For example, at least one of the charging means 2, the developing means 4, and the cleaning means 6 is combined with the photosensitive member 1 into one cartridge which is demountable from the main body of the apparatus by aid of a guiding means such as a rail in the main body of the apparatus.

When the electrophotographic apparatus is used as a copying machine or a printer, the optical image exposure light L may be projected onto the photosensitive member as reflected light or transmitted light from an original copy, or otherwise the information read out by a sensor from an original may be signalized, and light is projected, onto a photosensitive member, by scanning with a laser beam, driving an LED array, or driving a liquid crystal shutter array according to the signal.

Figure 2:
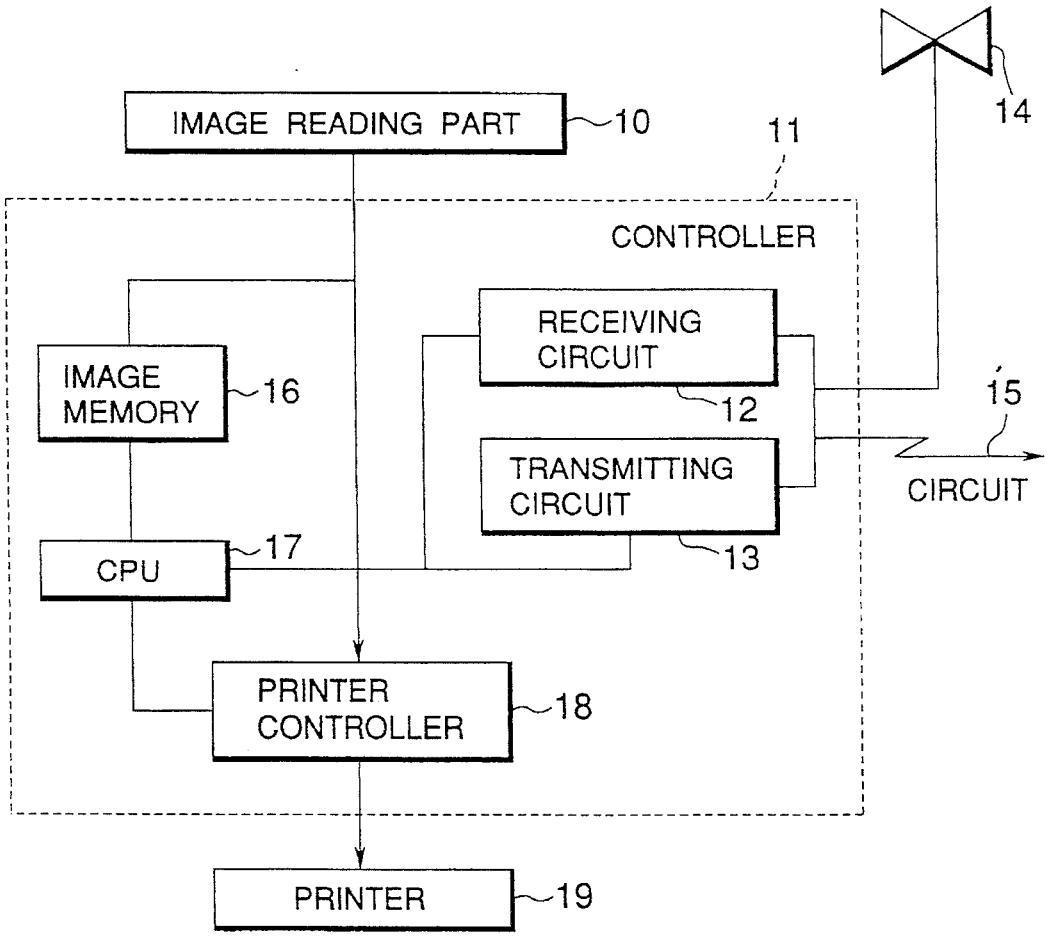
FIG. 2 shows an example of a block diagram of a facsimile system employing an electrophotographic photosensitive member of the present invention.

When the electrophotographic apparatus is used as a printer of a facsimile machine, the optical image exposure light L is employed for printing the received data. FIG. 2 is a block diagram of an example of this case.

A controller 11 controls the image-reading part 10 and a printer 19. The entire of the controller 11 is controlled by a CPU 17. Readout data from the image reading part 10 is transmitted through a transmitting circuit 13 to the other communication station. Data received from the other communication station is transmitted through a receiving circuit 12 to a printer 19. The image data is stored in an image memory 16. A printer controller 18 controls a printer 19. The numeral 14 denotes a telephone set.

The image received through a circuit 15, namely image information from a remote terminal connected through the circuit, is demodulated by the receiving circuit 12, treated for decoding of the image information in CPU 17, and successively stored in the image memory 16. When at least one page of image information has been stored in the image memory 16, the images are recorded in such a manner that the CPU 17 reads out one page of the image information, and sends out the one page of the decoded information to the printer controller 18, which controls the printer 19 on receiving the one page of the information from CPU 17 to record the image information. During recording by the printer 19, the CPU 17 receives the subsequent page of information.

Images are received and recorded in the manner as described above.

The present invention is described in more detail by reference to examples. In Examples, "parts" is based on weight.

EXAMPLE 1

On an aluminum plate, a solution of 5 parts of the polyamic acid represented by Exemplified Compound No. 3 in 95 parts of N,N-dimethylacetamide was applied with a Meyer bar, and was dried at 140° C. for 10 minutes to form an interlayer of 1 μm thick.

Separately, 5 parts of the azo pigment represented by the formula below:

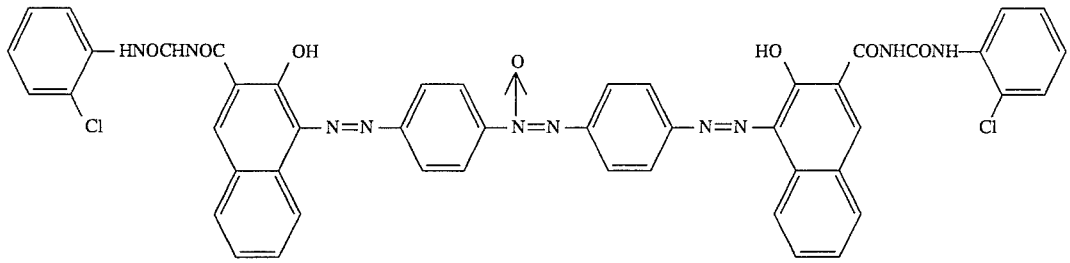

was added to 90 parts of tetrahydrofuran, and dispersed with a sand mill for 20 hours. To this dispersion, a solution of 2.5 parts of a butyral resin (BLS, produced by Sekisui Chemical Co., Ltd.) in 20 parts of tetrahydrofuran was added, and the mixture was treated for dispersion for further 2 hours. This dispersion was diluted with 100 parts of cyclohexanone and 100 parts of tetrahydrofuran. This diluted dispersion was applied on the aforementioned interlayer with a Meyer bar, and dried to form a charge-generating layer of 0.2 μm thick.

Then, a solution of 5 parts of triarylamine represented by the formula below:

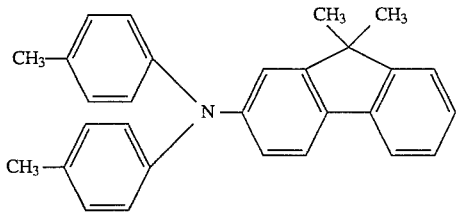

and 5 parts of a polycarbonate resin (Z-200, produced by Mitsubishi Gas Chemical Co., Ltd.) in 40 parts of monochlorobenzene was applied on the above-prepared charge-generating layer with a Meyer bar, and was dried to form a charge-transporting layer of 20 μm thick.

The prepared electrophotographic photosensitive member was tested for charging characteristics with an electrostatic copying machine tester (Model: SP-428, manufactured by Kawaguchi Denki K.K.). With the tester, the electrophotographic photosensitive member was charged negatively by corona discharge of −5 KV, was left in the dark for one second, and was exposed to light with a halogen lamp at an illuminance of 10 lux. The evaluated charging characteristics were the surface potential ($V_0$); the sensitivity ($E_{1/2}$, the quantity of light exposure required for decay of $V_0$ to ½ $V_0$); and the residual potential ($V_r$, the potential after the pre-exposure).

The results are shown in Table 1.

EXAMPLES 2–10

Electrophotographic photosensitive members were prepared and evaluated respectively in the same manner as in Example 1 except that the polyamic acid of Exemplified Compound No. 3 was replaced by the polyamic acid or the polyamic acid ester shown in Table 1. The results are shown in Table 1.

COMPARATIVE EXAMPLE 1

An electrophotographic photosensitive member was prepared and evaluated in the same manner as in Example 1 except that the interlayer was formed by use of a solution of 5 parts of an alcohol-soluble copolymer nylon (Amilan CM-8000, produced by Toray Industries, Inc.) in 95 parts of methanol.

The results are shown in Table 1.

COMPARATIVE EXAMPLE 2

An electrophotographic photosensitive member was prepared and evaluated in the same manner as in Example 1 except that interlayer was dried at 100° C. for 60 minutes and heat-treated at 250° C. for 3 hours. The amic acid structure in the resin of the interlayer was found to have converted entirely to an imide structure according to infrared spectroscopic analysis. The results are shown in Table 1.

EXAMPLE 11

An electrophotographic photosensitive member was prepared and evaluated in the same manner as in Example 1 except that an aluminum cylinder (outside diameter: 30 mm, length: 360 mm) was used in place of the aluminum plate, the interlayer was dried at 140° C. for 30 minutes, the thickness of the interlayer was 20 μm, and the respective layers were formed by dip coating.

The obtained electrophotographic photosensitive member was mounted on a normal development type of plain paper copying machine which conducts processes of electrostatic charging, light exposure, development, image-transfer, and cleaning at a cycle of 0.8 second, and tested for durability in 10,000 sheets of continuous image copying at low temperature and low humidity (15° C., 15% RH). The evaluation was made by measurement of the dark area potential ($V_D$) at the initial stage, the light area potentials ($V_L$) at the initial stage and after the durability test, and visual examination of the copied images.

Separately, the interlayer formed in the same manner as above without the subsequent photosensitive layer formation was tested for lattice pattern cut peeling test (according to JIS K-5400).

The results are shown in Table 2.

EXAMPLES 12–20

Electrophotographic photosensitive members were prepared and evaluated in the same manner as in Example 11 except that the coating liquids for interlayer formation in Examples 2 to 10 were used respectively.

The results are shown in Table 2.

COMPARATIVE EXAMPLE 3

An electrophotographic photosensitive member was prepared and evaluated in the same manner as in Example 11 except that the solutions for interlayer formation was the one used in Comparative Example 1.

The results are shown in Table 2.

COMPARATIVE EXAMPLE 4

An electrophotographic photosensitive member was prepared and evaluated in the same manner as in Example 11 except that the interlayer was formed with a solution of 14 parts of polyesterpolyol (Nipporane-125, produced by Nippon Polyurethane Industry Co., Ltd.), 6 parts of 2,6-tolylene diisocyanate, 0.02 parts of dibutyltin dilaurate in 80 parts methyl ethyl ketone.

The results are shown in Table 2.

COMPARATIVE EXAMPLE 5

An electrophotographic photosensitive member was prepared and evaluated in the same manner as in Example 11 except that the interlayer was formed with the interlayer coating liquid used in Comparative Example 2.

The results are shown in Table 2.

EXAMPLE 21

A coating liquid for formation of a first interlayer was prepared by mixing 25 parts of the polyamic acid of Exemplified Compound No. 3, 50 parts of electroconductive powdery titanium oxide coated with tin oxide containing 10% antimony oxide, and 25 parts of N,N-dimethylacetamide, and treating the mixture for dispersion with a sand mill for 20 hours. This liquid dispersion was applied on an aluminum plate with a Meyer bar, and dried at 140° C. for one hour to obtain the first interlayer which was 13 μm thick.

On the above first interlayer, another interlayer (second interlayer) was formed in a thickness of 0.5 μm in the same manner as formation of the interlayer of Example 1. Further thereon, a charge-generating layer and a charge-transporting layer were formed in the same manner as in Example 1. The obtained electrophotographic photosensitive member was evaluated in the same manner as in Example 1.

The results are shown in Table 3.

EXAMPLES 22–30

Electrophotographic photosensitive members were prepared and evaluated in the same manner as in Example 21 except that a polyamic acid or a polyamic acid ester shown in Table 3 was used respectively in place of Exemplified Compound No. 3.

The results are shown in Table 3.

COMPARATIVE EXAMPLE 6

An electrophotographic photosensitive member was prepared and evaluated in the same manner as in Example 21 except that the first interlayer was formed with a liquid dispersion which was composed of 25 parts of a resol type phenol resin (Plyophen J-325, produced by Dainippon Ink and Chemicals, Inc.), 50 parts of electroconductive powdery titanium oxide coated with tin oxide containing 10% antimony oxide, 25 parts of methylcellosolve, and 5 parts of methanol and was treated for dispersion with a sand mill for 20 hours; and the second interlayer was formed with a solution of 5 parts of an alcohol-soluble copolymer nylon (Amilan CM-8000, produced by Toray Industries, Inc.) in 95 parts of methanol.

The results are shown in Table 3.

EXAMPLES 31–34

Electrophotographic photosensitive members were prepared and evaluated respectively in the same manner as in Example 21, 24, 26, and 29 except that aluminum cylinder (outside diameter: 30 mm, length: 360 mm) was used in place of the aluminum plate, and the layers were formed by dip coating.

The electrophotographic photosensitive members were evaluated in the same manner as in Example 11 without conducting the lattice pattern cut peeling test.

The results are shown in Table 4.

EXAMPLES 35–38

On an aluminum cylinder, a first interlayer and a second interlayer were formed respectively in the same manner as in Examples 21, 24, 26, or 29.

Separately, a coating liquid for formation of a charge-generating layer was prepared by adding 4 parts of oxytitanium phthalocyanine pigment into a solution of 2 parts of polyvinylbutyral (BX-1, produced by Sekisui Chemical Co., Ltd.) in 34 parts of cyclohexanone, treating the mixture for dispersion by means of a sand mill for 8 hours, and diluting the dispersion with 60 parts of tetrahydrofuran. This liquid was applied on the above interlayer and dried to form a charge-generating layer of 0.2 μm thick.

A charge-transporting layer was formed in the same manner as in Example 11.

The obtained electrophotographic photosensitive member was mounted on a reversal development type of laser beam printer which conducts the steps of charging, exposure, development, image-transfer, and cleaning in a cycle of 6 seconds, and tested for durability in 5,000 sheets of continuous image printing at high temperature and high humidity (30° C., 85% RH). The evaluation was made by measurement of the dark area potential ($V_D$) at the initial stage, the light area potentials ($V_L$) at the initial stage and after the durability test, and visual examination of the printed images.

The results are shown in Table 5.

COMPARATIVE EXAMPLE 7

An electrophotographic photosensitive member was prepared and evaluated in the same manner as in Example 35 except that the first interlayer and the second layer were formed with the same manner as in Comparative Example 6 by dip coating.

The results are shown in Table 5.

TABLE 1

| | Exemplified compound No. | $E_{1/2}$ (lux · sec) | $V_r$ (–V) | Ratio of amic acid or amic acid ester structure (%) |
|---|---|---|---|---|
| Example | | | | |
| 1 | 3 | 1.23 | 0 | 43 |
| 2 | 1 | 1.20 | 0 | 58 |
| 3 | 4 | 1.35 | 0 | 43 |
| 4 | 51 | 1.15 | 0 | 55 |
| 5 | 12 | 1.18 | 0 | 45 |
| 6 | 26 | 1.35 | 0 | 49 |
| 7 | 31 | 1.35 | 0 | 22 |
| 8 | 10 | 1.17 | 0 | 75 |
| 9 | 79 | 1.21 | 0 | 48 |
| 10 | 80 | 1.11 | 0 | 65 |
| Comparative Example | | | | |
| 1 | — | 1.58 | 0 | — |
| 2 | — | 1.70 | 33 | 0 |

TABLE 2

| | At initial stage | | After durability test | | Peeling ratio |
|---|---|---|---|---|---|
| | $V_D$ (–V) | $V_L$ (–V) | $V_L$ (–V) | Image quality | (%) |
| Example | | | | | |
| 11 | 670 | 175 | 180 | Good | 0 |
| 12 | 690 | 180 | 200 | Good | 0 |
| 13 | 665 | 185 | 200 | Good | 0 |
| 14 | 685 | 170 | 180 | Good | 0 |
| 15 | 700 | 195 | 195 | Good | 0 |
| 16 | 700 | 195 | 200 | Good | 0 |
| 17 | 700 | 205 | 210 | Good | 0 |
| 18 | 700 | 180 | 190 | Good | 0 |
| 19 | 695 | 195 | 210 | Good | 0 |
| 20 | 695 | 200 | 220 | Good | 0 |
| Comparative Example | | | | | |
| 3 | 665 | 210 | 325 | Fogging occurred | 25 |
| 4 | 670 | 220 | 360 | Fogging occurred | 29 |
| 5 | 710 | 225 | 310 | Fogging occurred | 0 |

TABLE 3

| | Exemplified compound No. | | | |
|---|---|---|---|---|
| | First interlayer | Second interlayer | $E_{1/2}$ (lux · sec) | $V_r$ (−V) |
| Example | | | | |
| 21 | 3 | 3 | 1.01 | 0 |
| 22 | 1 | 1 | 1.04 | 0 |
| 23 | 4 | 4 | 1.03 | 0 |
| 24 | 51 | 51 | 1.09 | 0 |
| 25 | 12 | 12 | 1.06 | 0 |
| 26 | 26 | 26 | 1.29 | 0 |
| 27 | 31 | 31 | 1.30 | 0 |
| 28 | 10 | 10 | 1.03 | 0 |
| 29 | 52 | 52 | 1.30 | 0 |
| 30 | 55 | 56 | 1.23 | 0 |
| Comparative Example | | | | |
| 6 | — | — | 1.55 | 0 |

TABLE 4

| | At initial stage | | After durability test | |
|---|---|---|---|---|
| Example | $V_D$ (−V) | $V_L$ (−V) | $V_L$ (−V) | Image quality |
| 31 | 700 | 165 | 170 | Good |
| 32 | 710 | 160 | 170 | Good |
| 33 | 700 | 195 | 200 | Good |
| 34 | 700 | 195 | 195 | Good |

TABLE 5

| | At initial stage | | After durability test | |
|---|---|---|---|---|
| | $V_D$ (−V) | $V_L$ (−V) | $V_L$ (−V) | Image quality |
| Example | | | | |
| 35 | 700 | 195 | 200 | Good |
| 36 | 685 | 170 | 180 | Good |
| 37 | 690 | 200 | 210 | Good |
| 38 | 695 | 150 | 155 | Good |
| Comparative Example | | | | |
| 7 | 680 | 190 | 230 | Black dots observed |

What is claimed is:

1. An electrophotographic photosensitive member, comprising an electroconductive support, an interlayer formed on the electroconductive support, and a photosensitive layer formed on the interlayer, the interlayer containing a resin having a polyamic acid structure or a polyamic acid ester structure, wherein the resin has an amic acid structure or an amic acid ester structure of Formula (2):

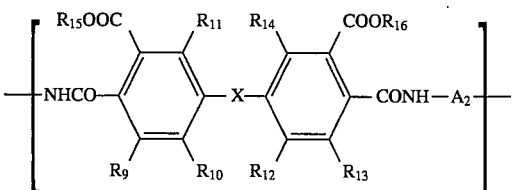

(2)

where $A_2$ is a bivalent organic group; $R_9$ to $R_{14}$ are independently a hydrogen atom, a halogen atom, a substituted or unsubstituted alkyl group, a substituted or unsubstituted alkoxy group, or a cyano group; $R_{15}$ and $R_{16}$ are independently a hydrogen atom, a substituted or unsubstituted alkyl group, a substituted or unsubstituted alkoxyalkyl group, or a substituted or unsubstituted aralkyl group; and X is an oxygen atom, a substituted or unsubstituted alkylene group, a carbonyl group, or a sulfonyl group.

2. The electrophotographic photosensitive member according to claim 1, wherein $A_2$ is represented by Formula (3) or (4):

$$—Ar_1— \quad (3)$$

where $Ar_1$ is a substituted or unsubstituted aromatic hydrocarbon group or a substituted or unsubstituted aromatic heterocyclic group; or $$—Ar_2—Y—Ar_3— \quad (4)$$

where $Ar_2$ and $Ar_3$ are independently a substituted or unsubstituted aromatic hydrocarbon group or a substituted or unsubstituted aromatic heterocyclic group; and Y is an oxygen atom, a sulfur atom, a substituted or unsubstituted alkylene group, a carbonyl group, or a sulfonyl group.

3. The electrophotographic photosensitive member according to claim 2, wherein $A_2$ is represented by Formula (4).

4. The electrophotographic photosensitive member according to claim 1, wherein the interlayer contains an electroconductive substance.

5. The electrophotographic photosensitive member according to claim 4, wherein the interlayer is constituted of a first layer containing an electroconductive substance and a second layer containing no electroconductive substance.

6. The electrophotographic photosensitive member according to claim 1, wherein the photosensitive layer is constituted of a charge-generating layer and a charge transporting layer.

7. The electrophotographic photosensitive member according to claim 1, wherein the electrophotographic photosensitive member is constituted of an electroconductive support, an interlayer, a charge-generating layer, and a charge-transporting layer, arranged in the order named.

8. The electrophotographic photosensitive member according to claim 1, wherein the resin has a segment having the amic acid structure and amic acid ester structure in an amount of 20 to 80 mol % of segments in the entire resin.

9. The electrophotographic photosensitive member according to claim 8, wherein the resin has a segment having the amic acid structure and amic acid ester structure in an amount of 40 to 60 mol % of segments in the entire resin.

10. A process cartridge, comprising an electrophotographic photosensitive member, and at least one of an electrostatic charging means, a developing means, and a cleaning means;

said electrophotographic photosensitive member comprising an electroconductive support, an interlayer formed on the electroconductive support, and a photosensitive layer formed on the interlayer, the interlayer containing a resin having a polyamic acid structure or a polyamic acid ester structure;

said electrophotographic photosensitive member and at least one of the electrostatic charging means, the developing means, and the cleaning means being integrated in one body to be demountable from a main body of an electrophotographic apparatus, wherein the resin has an amic acid structure or an amic acid ester structure of Formula (2):

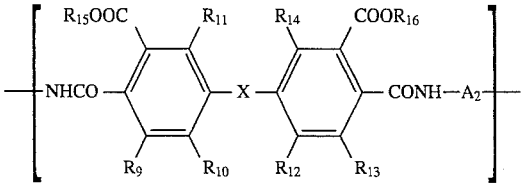

(2)

where $A_2$ is a bivalent organic group; $R_9$ to $R_{14}$ are independently a hydrogen atom, a halogen atom, a substituted or unsubstituted alkyl group, a substituted or unsubstituted alkoxy group, or a cyano group; $R_{15}$ and $R_{16}$ are independently a hydrogen atom, a substituted or unsubstituted alkyl group, a substituted or unsubstituted alkoxyalkyl group, or a substituted or unsubstituted aralkyl group; and X is an oxygen atom, a substituted or unsubstituted alkylene group, a carbonyl group, or a sulfonlyl group.

11. An electrophotographic apparatus, comprising an electrophotographic photosensitive member, an electrostatic charging means, an image exposure means, a developing means, and an image transfer means;

said electrophotographic photosensitive member comprising an electroconductive support, an interlayer formed on the electroconductive support, and a photosensitive layer formed on the interlayer, the interlayer containing a resin having a polyamic acid structure or a polyamic acid ester structure, wherein the resin has an amic acid structure or an amic acid ester structure of Formula (2):

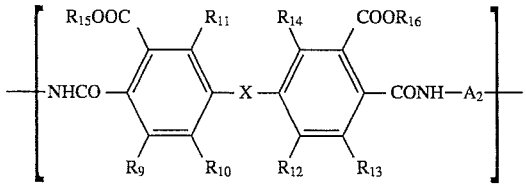

(2)

where $A_2$ is a bivalent organic group $R_9$ to $R_{14}$ are independently a hydrogen atom, a halogen atom, a substituted or unsubstituted alkyl group, a substituted or unsubstituted alkoxy group, or a cyano group; $R_{15}$ and $R_{16}$ are independently a hydrogen atom, a substituted or unsubstituted alkyl group, a substituted or unsubstituted alkoxyalkyl group, or a substituted or unsubstituted aralkyl group; and X is an oxygen atom, a substituted or unsubstituted alkylene group, a carbonyl group, or a sulfonyl group.

12. An electrophotographic photosensitive member, comprising an electroconductive support, an interlayer formed on the electroconductive support, and a photosensitive layer formed on the interlayer, the interlayer containing a resin having a polyamic acid structure or a polyamic acid ester structure of Formula (1)

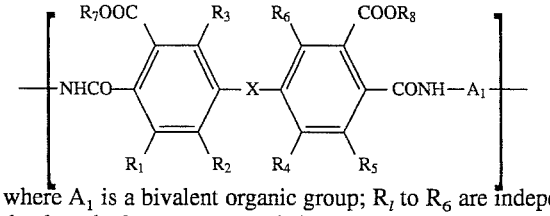

(1)

where $A_1$ is a bivalent organic group; $R_l$ to $R_6$ are independently a hydrogen atom, a halogen atom, a substituted or unsubstituted alkyl group, a substituted or unsubstituted alkoxy group, or a cyano group; and $R_7$ and $R_8$ are independently a hydrogen atom, a substituted or unsubstituted alkyl group, a substituted or unsubstituted alkoxyalkyl group, or a substituted or unsubstituted aralkyl group;

wherein the interlayer is free of a conductive substance.

13. The electrophotographic photosensitive member according to claim 12, wherein $A_1$ is represented by Formula (3) or (4):

$$—Ar_1— \quad (3)$$

where $Ar_1$ is a substituted or unsubstituted aromatic hydrocarbon group or a substituted or unsubstituted aromatic heterocyclic group; or $$—Ar_2—Y—Ar_3— \quad (4)$$

where $Ar_2$ and $Ar_3$ are independently a substituted or unsubstituted aromatic hydrocarbon group or a substituted or unsubstituted aromatic heterocyclic group and Y is an oxygen atom, a sulfur atom, a substituted or unsubstituted alkylene group, a carbonyl group, or a sulfonyl group.

14. The electrophotographic photosensitive member according to claim 13, wherein $A_1$ is represented by Formula (4).

15. The electrophotographic photosensitive member according to claim 12, wherein the photosensitive layer is constituted of a charge-generating layer and a charge-transporting layer.

16. The electrophotographic photosensitive member according to claim 12, wherein the electrophotographic photosensitive member is constituted of, in sequence, an electroconductive support, an interlayer, a charge-generating layer, and a charge-transporting layer.

17. The electrophotographic photosensitive member according to claim 12, wherein the resin has a segment having the amic acid structure and amic acid ester structure in an amount of 20 to 80 mol % of segments in the entire resin.

18. The electrophotographic photosensitive member according to claim 17, wherein the resin has a segment having the amic acid structure and amic acid ester structure in an amount of 40 to 60 mol % of segments in the entire resin.

19. A process cartridge, comprising an electrophotographic photosensitive member, and at least one of an electrostatic charging means, a developing means, and a cleaning means;

said electrophotographic photosensitive member comprising an electroconductive support, an interlayer formed on the electroconductive support, and a photosensitive layer formed on the interlayer, the interlayer containing a resin having a polyamic acid structure or a polyamic acid ester structure;

said electrophotographic photosensitive member and at least one of the electrostatic charging means, the developing means, and the cleaning means being integrated in one body to be demountable from a main body of an electrophotographic apparatus, wherein the resin has an amic acid structure or an amic acid ester structure of Formula (1):

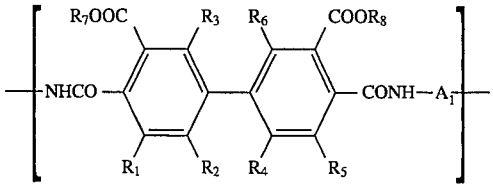

(1)

where $A_1$ is a bivalent organic group; $R_1$ to $R_6$ are independently a hydrogen atom, a halogen atom, a substituted or unsubstituted alkyl group, a substituted or unsubstituted alkoxy group, or a cyano group; and $R_7$ and $R_8$ are independently a hydrogen atom, a substituted or unsubstituted alkyl group, a substituted or unsubstituted alkoxyalkyl group, or a substituted or unsubstituted aralkyl group;

wherein the interlayer is free of a conductive substance.

20. An electrophotographic apparatus, comprising an electrophotographic photosensitive member, an electrostatic charging means, an image exposure means, a developing means, and an image transfer means;

said electrophotographic photosensitive member comprising an electroconductive support, an interlayer formed on the electroconductive support, and a photosensitive layer formed on the interlayer, the interlayer containing a resin having a polyamic acid structure or a polyamic acid ester structure, wherein the resin has an amic acid structure or an amic acid ester structure of Formula (1):

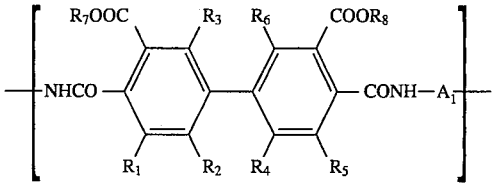

(1)

where $A_1$ is a bivalent organic group; $R_1$ to $R_6$ are independently a hydrogen atom, a halogen atom, a substituted or unsubstituted alkyl group, a substituted or unsubstituted alkoxy group, or a cyano group; and $R_7$ and $R_8$ are independently a hydrogen atom, a substituted or unsubstituted alkyl group, a substituted or unsubstituted alkoxyalkyl group, or a substituted or unsubstituted aralkyl group;

wherein the interlayer is free of a conductive substance.

* * * * *

UNITED STATES PATENT AND TRADEMARK OFFICE

CERTIFICATE OF CORRECTION

PATENT NO. : 5,486,440

DATED : January 23, 1996

INVENTOR(S) : YOSHIO KASHIZAKI ET AL.

It is certified that error appears in the above-identified patent and that said Letters Patent is hereby corrected as shown below:

On the title page:

AT [56] REFERENCES CITED

Foreign Patent Documents,
"2115858" should read --2-115858--.

AT [57] ABSTRACT

Line 5, "electrographic" should read --electrophotographic--.

COLUMN 8

Line 1, "and $R_{14}$" should read --and $R_9$ to $R_{14}$--.

COLUMN 23

Comp. No. 91, "Br" should read --$CH_3$--.

COLUMN 25

Line 56, "$H_1$-NMR" should read --$H^1$-NMR--.

COLUMN 27

Line 6, "base" should read --based--.

COLUMN 28

Line 27, "above mentioned" should read --above-mentioned--.

UNITED STATES PATENT AND TRADEMARK OFFICE

CERTIFICATE OF CORRECTION

PATENT NO. : 5,486,440

DATED : January 23, 1996

INVENTOR(S) : YOSHIO KASHIZAKI ET AL.

It is certified that error appears in the above-identified patent and that said Letters Patent is hereby corrected as shown below:

COLUMN 29

Line 55, "entire" should read --entirety--.

COLUMN 32

Line 4, "solutions" should read --solution--.

COLUMN 33

Line 10, "Example 21," should read --Examples 21,--.

COLUMN 37

Line 42, "group $R_9$" should read --group; $R_9$--.

Signed and Sealed this

Twenty-fifth Day of June, 1996

Bruce Lehman

*Attest:*

BRUCE LEHMAN

*Attesting Officer*

*Commissioner of Patents and Trademarks*